US009476432B2

(12) United States Patent
Greenwood et al.

(10) Patent No.: US 9,476,432 B2
(45) Date of Patent: Oct. 25, 2016

(54) HYDRAULIC VALVE ASSEMBLY WITH TANK RETURN FLOW COMPENSATION

(71) Applicant: HUSCO International, Inc., Waukesha, WI (US)

(72) Inventors: Jason Greenwood, Brookfield, WI (US); Matthew J. Rades, Oconomowoc, WI (US); Susan Kelpin, Muskego, WI (US)

(73) Assignee: HUSCO International, Inc., Waukesha, WI (US)

( * ) Notice: Subject to any disclaimer, the term of this patent is extended or adjusted under 35 U.S.C. 154(b) by 280 days.

(21) Appl. No.: 14/046,328

(22) Filed: Oct. 4, 2013

(65) Prior Publication Data

US 2015/0096619 A1 Apr. 9, 2015

(51) Int. Cl.

*F15B 13/043* (2006.01)
*F15B 13/01* (2006.01)
*F15B 13/02* (2006.01)

(52) U.S. Cl.

CPC ..... *F15B 13/0433* (2013.01); *F15B 13/015* (2013.01); *F15B 13/021* (2013.01); *F15B 2211/353* (2013.01); *Y10T 137/0318* (2015.04); *Y10T 137/86879* (2015.04)

(58) Field of Classification Search

USPC ..... 137/625.61, 625.64, 625.66
See application file for complete search history.

(56) References Cited

U.S. PATENT DOCUMENTS

| | | | | |
|---|---|---|---|---|
| 6,637,461 | B2 * | 10/2003 | Post | F15B 13/0402 137/625.63 |
| 7,252,116 | B2 * | 8/2007 | Miyazoe | F15B 13/0825 137/271 |
| 7,487,707 | B2 | 2/2009 | Pfaff et al. | |
| 2006/0130914 | A1 * | 6/2006 | Barber | F15B 9/12 137/625.64 |
| 2007/0144588 | A1 | 6/2007 | Barber | |
| 2010/0096576 | A1 * | 4/2010 | Sommer | B60T 11/30 251/129.15 |

* cited by examiner

*Primary Examiner* — Craig Schneider
*Assistant Examiner* — Paul Gray
(74) *Attorney, Agent, or Firm* — Quarles & Brady LLp

(57) ABSTRACT

An apparatus has a pilot-operated spool valve connecting first and second work passages selectively to a supply conduit and a tank conduit. A first check valve normally allows fluid flow only in one direction from the first work passage to a first workport and when pilot-operated allows bidirectional fluid flow. A second check valve normally allows fluid flow only from the second work passage to a second workport and when pilot-operated allows bidirectional fluid flow. A first pilot valve selectively applies pressure to one end of the spool and to pilot operate the first check valve. A second pilot valve selectively applies pressure to another end of the spool and to pilot operate the second check valve. When fluid drains from a workport to the tank conduit, the associated check valve operates to maintain a predefined pressure in the first or second work passage through which that fluid flows.

20 Claims, 1 Drawing Sheet

HYDRAULIC VALVE ASSEMBLY WITH TANK RETURN FLOW COMPENSATION

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to hydraulic systems that operate actuators, such as cylinder-piston arrangements, and more particularly to valve assemblies that control flow of fluid to and from the actuators.

2. Description of the Related Art

A wide variety of machines are operated by a hydraulic system that has one or more hydraulic actuators, such as piston-cylinder arrangements or hydraulic motors, which move components on the machine. A separate valve assembly controls the flow of pressurized fluid from a pump to each hydraulic actuator and the return of that fluid to a reservoir tank. One common type of valve assembly has a spool that is moved in a bore by pilot pressure selectively applied to surfaces at opposite ends of the spool. The spool has annular notches that, in different positions of the spool, provide paths between various passages which open into the bore and which connect to the hydraulic actuator, the pump, and the reservoir tank. Some of those paths have variable control, or metering, orifices through which the fluid flows.

The speed of the hydraulic actuator depends on the cross-sectional area and the pressure drop across those variable control orifices. To facilitate control of the actuator, pressure compensating devices have been designed to set and maintain the pressure drop. The result is a self-adjusting system that provides a substantially constant pressure drop across the control orifice. Therefore, with the pressure drop being held constant, the speed of the hydraulic actuator is determined only by the cross sectional area of the control orifice that is varied by the machine operator.

For some types of equipment, such as implements attached to the hitch on an agricultural tractor, it is desirable also to provide pressure compensation in the tank return fluid path through the valve assembly. For example, some agricultural implements place a relatively large gravitational load on the hydraulic actuator of the tractor hitch. Thus lowering the implement can take advantage of the resultant force to drive fluid out of the actuator to the tank and that return flow can be controlled to adjust the rate at which the implement lowers.

SUMMARY OF THE INVENTION

A valve assembly has a spool valve that selectively controls the flow of fluid from a source of pressurized fluid to a workport and fluid flow from the workport to a return conduit connected to a tank. A pressure compensator defines pressure at a port through which fluid flowing return path from the workport enters the spool valve and operates to maintain that pressure at a desired level. The pressure compensator comprises a pilot-operated check valve that in a deactivated state blocks the return path. Application of a pilot pressure to the pilot-operated check valve unblocks the return path. A control valve, such as a solenoid operated valve, proportionally controls the application of the pilot pressure so that the check valve functions the pressure compensator when fluid flows there through from the workport to the return conduit.

DETAILED DESCRIPTION OF THE INVENTION

Figure 1:
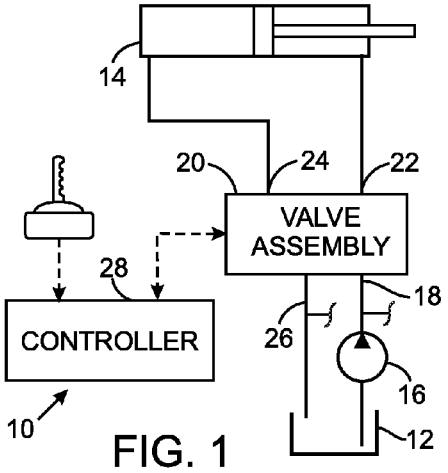
FIG. 1 is a schematic diagram of a hydraulic system with a valve assembly that incorporates the present invention.

References herein to directional relationships and movement, such as top and bottom or left and right, refer to the relationship and movement of the components in the orientation illustrated in the drawings, which may not be the orientation of the components as attached to a machine. The term "directly connected" as used herein means that the associated components are connected together by a conduit without any intervening element, such as a valve, an orifice or other device, which restricts or controls the flow of fluid beyond the inherent restriction of any conduit.

With initial reference to FIG. 1, a hydraulic system 10 has a tank 12 that serves as a reservoir containing fluid for driving a hydraulic actuator 14, such as a piston-cylinder arrangement. Alternatively, the system may drive a hydraulic motor or other type of actuator. A pump 16 draws fluid from the tank 12 and provides that fluid at a desired pressure via a supply conduit 18 to a valve assembly 20. The valve assembly 20 selectively applies the pressurized fluid to one of two workports 22 and 24 connected to the hydraulic actuator 14. Fluid returns from the hydraulic actuator 14 to the other workport and is routed by the valve assembly 20 through a tank conduit 26 to the tank 12. An electronic controller 28 controls one or more solenoid operators in the valve assembly 20 that selectively determine which workport 22 or 24 is connected to the supply conduit 18 and which is connected to the tank conduit 26. That selected connection determines the direction that the hydraulic actuator 14 moves. The activation of the solenoid operators also controls the amount that the valve assembly opens and the pressure drop across the opening thereby proportionally varying the rate of fluid flow and thus the speed of the hydraulic actuator.

Figure 2:
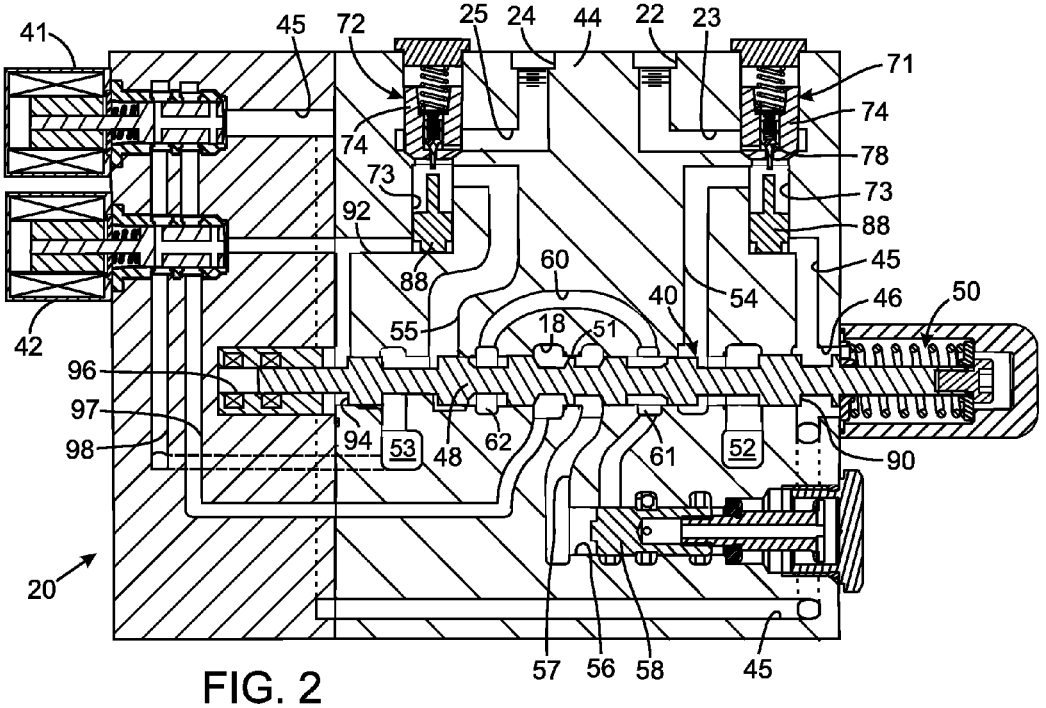
FIG. 2 is a cross section view through the valve assembly.

Referring to FIG. 2, the valve assembly 20 includes a spool valve 40, which is pilot-operated by two electrohydraulic pilot valves 41 and 42 activated by the controller 28. As used herein, a "pilot valve" is a valve that is controlled to produce an output pressure signal that is used to operate another valve, referred to as a pilot-operated valve. The spool valve 40 comprises a primary bore 46 in a valve body 44 that also has fluid passages and ports opening into the primary bore. A spool 48 reciprocates longitudinally within the primary bore 46 to control the flow of hydraulic fluid to and from the pair of workports 22 and 24. The spool 48 has a plurality of axially spaced annular grooves with lands located there between, which cooperate with the primary bore 46 to open and close fluid paths between different cavities and passage openings in that bore, as will be described. A dual action spring assembly 50 is connected to a first end of the spool 48 to return the spool to the illustrated centered position in the primary bore 46 when both the pilot valves 41 and 42 are de-energized.

A pair of tank passages 52 and 53 extends from the tank conduit 26 (FIG. 1) through the valve body 44 perpendicular to the plane of the cross-section of FIG. 2 and have link passages that connect to the primary bore 46. The supply conduit 18 also extends through the valve body 44 in that manner. In selected positions of the spool 48 an orifice 51 opens to provide a path from the supply conduit 18 into a branch passage 57 that opens into secondary bore 56. A conventional supply pressure compensation valve 58 is located in the secondary bore 56 and controls the flow of hydraulic fluid into a bridge passage 60 that opens into a pair of supply cavities 61 and 62 around the primary bore 46.

When the spool valve 40 is in the centered position illustrated in FIG. 2, the two work passages 54 and 55 are connected to tank passages 52 and 53, respectively. Movement of the spool 48 to the left in the drawing maintains the return path between the first tank passage 52 and the first work passage 54. That leftward motion opens a variable control orifice between the second work passage 55 and the second supply cavity 62, thereby introducing pressurized fluid from the bridge passage 60 into the second work passage. Thus moving the spool 48 to the left of center feeds fluid from the pump 16 into the second work passage 55 and provides a path between first work passage 54 and the tank 12. Opposite movement of the spool 48 from the centered position to the right, maintains the return path between the second tank passage 53 and the second work passage 55. The rightward motion opens a variable control orifice between the first supply cavity 61 and the first work passage 54. Therefore, moving the spool 48 to the right of center applies pressurized fluid from pump 16 to the first work passage 54 and provides a path between the second work passage 55 and the tank 12.

Figure 3:
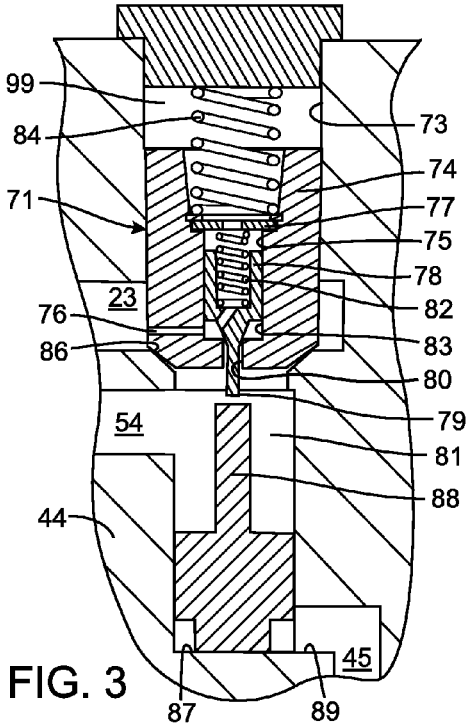
FIG. 3 is an enlarged section of FIG. 2 showing details of a tank return flow compensation valve.

Each of the first and second workports 22 and 24 is coupled to one of the work passages 54 and 55 by a separate return compensated, pilot-operated check valve 71 and 72, respectively. In a deactivated state in which the check valve 71 or 72 is not pilot-operated, fluid is permitted to flow only in a direction from the respective work passage to the associated workport, as occurs when the pressurized fluid from the pump is directed by the spool valve 40 to that particular workport. The details of the first check valve 71 are shown in FIG. 3 with the understanding that the second check valve 72 has an identical construction, however other types of check valves may be used. The first check valve 71 is located in a secondary bore 73 that is connected to first work passage 54 and to a first workport passage 23 which leads to the first workport 22. A valve seat 86 is located in the secondary bore 73 between those passages 23 and 54. A main poppet 74 of the first check valve is slideably received in the secondary bore 73, A poppet bore 75 extends from one end into the main poppet 74 and a pilot passage 80 extends between the poppet bore 75 and a poppet chamber 81 formed in the secondary bore 73 at the opposite end of the main poppet 74. The first work passage 54 communicates with the poppet chamber 81. A pilot poppet 78, received within the poppet bore 75, has a tip 79 that extends through a pilot passage 80 in the main poppet 74 and projects outwardly therefrom into the poppet chamber 81. The pilot poppet 78 defines a pilot chamber 83 and the end of the poppet bore 75 into which the pilot passage 80 opens and a lateral passage 76 provides a fluid path between the pilot chamber 83 and the first workport passage 23. A first spring 82 biases the pilot poppet 78 to close the pilot passage 80 blocking fluid flow between the pilot chamber 83 and the poppet chamber 81. A second spring 84 biases the main poppet 74, with respect to the valve body 44, into engagement with the valve seat 86, thereby closing direct communication between those passages.

The secondary bore 73 extends farther downward and has a lower end 87 with a control port 89 into which a first pilot pressure passage 45 opens. A pilot pusher 88 is slideably received within the lower portion of the secondary bore 73. The pilot pusher 88 is forced upward in an activated state by the pressure in the first pilot pressure passage 45 and into engagement with the tip 79 of the pilot poppet 78, as will be described.

Referring to both FIGS. 2 and 3, the first pilot pressure passage 45 also communicates with a first actuator surface 90 near the right end of the spool 48 and that passage continues through the valve body 44 to the outlet of the electrohydraulic first pilot valve 41. A second pilot pressure passage 92 extends from the outlet of the electrohydraulic second pilot valve 42 to the lower end of the secondary bore for the second pilot-operated check valve 72. The second pilot pressure passage 92 also opens into a cavity the primary bore 46 to apply pressure to a second actuator surface 94 near the left end of the spool 48. The extreme left end of the spool 48 is located inside a position sensor 96, such as a Hall effect device, that produces electrical signals which provide indications to the controller 28 of the relative position of the spool 48 within the primary bore 46.

Both the electrohydraulic first and second pilot valves 41 and 42 are spool valves that are operated by electric currents from the controller 28. Those pilot valves 41 and 42 have ports which receive fluid from the supply conduit 18 via a feeder passage 97. Each pilot valve 41 and 42 has a drain port 98 which connected to one of the tank passages 52 or 53.

When it is desired to operate the hydraulic actuator 14, the controller 28 applies electric current to the first and second pilot valves 41 and 42 which opens those valves and conveys supply conduit fluid from the feeder passage 97 into the first and second pilot pressure passages 45 and 92. The magnitudes of those electric currents determine the degree that each pilot valve 41 and 42 opens to control flow into an out of the pressure passages 45 and 92 leading to the opposing first and second actuator surfaces 90 and 94 adjacent opposite ends of the spool 48. When the amount of pressure applied to one actuator surface is sufficiently different than the amount of pressure applied to the other actuator surface, a net force is applied to the spool 48 that overcomes the spool centering force of the spring assembly 50. Thus, the spool 48 slides within the primary bore 46 toward the end at which the lower pressure was applied. The orientation of the pressure differential and the resulting net force governs the direction and distance that the spool valve moves. That is, if the pressure applied from the first pilot valve 41 to the first actuator surface 90 is greater than the pressure applied by the second pilot valve 42 to the second actuator surface 94, the spool 48 is biased to move to the left in FIG. 2, wherein the valve assembly 20 is in a first operating mode. The spool 48 eventually reaches a first position at which the spool provides a first fluid path between first work passage 54 and the first tank passage 52, and a second fluid path is provided between second work passage 55 and bridge passage 60. At that time, the supply pressure compensation valve 58 opens conveying fluid from the supply conduit 18 to the bridge passage 60. Alternatively, when the valve assembly 20 is in a second operating mode, a greater pressure is applied to the second actuator surface 94 than is applied to the first actuator surface 90. This pressure difference causes the spool 48 to move to the right in FIG. 2 eventually reaching a second position. Now the spool 48 provides a third fluid path between first work passage 54 and bridge passage 60 that now receives fluid from the supply conduit 18, and provides a fourth fluid path between second work passage 55 and the second tank passage 53.

In both the first and second operating modes, the magnitude of the pressure differential between the first and second actuator surfaces 90 and 94 determines the distance that the spool 48 moves from the center spool position. The distance varies the size of the spool control orifices between the bridge passage 60 and one of the workports and between the other workport and a tank passage 52 or 53, thereby varying the fluid flow through the valve assembly 20. The pressure differential can be controlled and thus the position of the spool varied to produce the desired flow of pressurized supply fluid to the hydraulic actuator 14 and control the flow rate of fluid exhausting from the hydraulic actuator.

Additionally in both the first and second operating modes, the two pressure signals that the pilot valves 41 and 42 create in the first and second pilot pressure passages 45 and 92 also are applied to the control ports 89 of the first and second pilot-operated check valves 71 and 72, respectively. In each check valve, that control port pressure raises the pusher 88 up against the tip 79 of the pilot poppet 78. If the respective control port pressure is sufficiently great, continued upward motion of the pusher 88 occurs that unseats the respective pilot poppet 78 opening the pilot passage 80 in the nose of the main poppet 74. This pilot operation releases the pressure in a control chamber 99 on the opposite side of the main poppet 74 in that check valve 71 or 72, which enables its main poppet 74 to move off the associated valve seat 86, thereby opening a fluid path through the check valve between the respective first or second work passage 54 or 55 and the associated first or second workport passage 23 or 25.

Assume that it is desired to place the valve assembly 20 in the first operating mode in which fluid from the supply conduit 18 is fed to the second workport 24 and fluid is drained from the first workport 22 to the tank conduit 26. The controller 28 applies given levels of electric current to each of the first and second pilot valves 41 and 42 to create desired pressure levels in the first and second pilot pressure passages 45 and 92. Specifically, a first pressure level is produced in the first pilot pressure passage 45 that is greater than a second pressure level produced in the second pilot pressure passage 92. Those different pressure levels when applied to the first and second actuator surfaces 90 and 94 exert a net force on the spool 48 causing the spool to move proportionally leftward into the first position in which the first fluid path is established between the first work passage 54 and first tank passage 52 and the second fluid path is established between the second work passage 55 and bridge passage 60.

In the first operating mode, fluid is to be drained from the first workport 22 to the first tank passage 52. For that to occur, the first pilot pressure signal applied via the first pilot pressure passage 45 to the first check valve 71 drives the respective pusher 88 against the associated pilot poppet 78 with sufficient force to open the corresponding pilot passage 80. That action places the first check valve 71 in an activated state in which pressure in the first check valve's control chamber 99 is released through the pilot passage 80. That pressure release enables the pressure in the first workport passage 23 to lift the main poppet 74 off its seat 86 and feed the workport fluid into the first work passage 54. The workport fluid keeps on flowing from the first work passage 54 through the spool 48 and into the first tank passage 52. The main poppet 74 in the first check valve 71 continues to move upward until the pilot poppet 78 again closes the pilot passage 80. The extent of that motion determines the size of an opening between the main poppet 74 and its valve seat 86.

While the first check valve 71 is open, if the pressure within the first work passage 54 changes with respect to the pilot pressure within the first pilot pressure passage 45, the forces acting on the pusher 88 change correspondingly which results in the pusher moving toward or away from the main poppet 74. Such motion of the pusher 88 results in corresponding up or down motion of the main poppet 74, thereby varying the size of the opening at valve seat 86. This main poppet motion maintains the pressure in the first work passage 54 equal to the pilot pressure in the first pilot pressure passage 45 despite pressure fluctuation at the first workport 22. The pressure in the first work passage 54 can be adjusted by controlling the first pilot valve 41 to produce a desired pressure level in the first pilot pressure passage 45. When the pressure level in the first pilot pressure passage 45 is adjusted, the second pilot valve 41 typically is controlled to produce a similar adjustment of the pressure level in the second pilot pressure passage 92. Therefore, the pressure adjustment to control pressure in the first work passage 54 does not change the difference in pressure levels in the first and second pilot pressure passage 45 and 92 and does not alter the position of the spool 48 that is operated by those pressure levels. Thus this mechanism allows the work passage pressure to be selectively controlled without changing the spool position.

The pilot pressure applied to the first check valve 71, that at this time is in the path of the fluid draining from the hydraulic actuator 14 to the tank 12, controls the pressure drop across the control orifice of the spool valve 40 in that drain path. The present system has the advantage that this pressure drop can be varied by altering the pilot pressure that the first pilot valve 41 applies to the first check valve 71 in the fluid drain path.

Also, the first position of the spool 48 in the first operating mode provides a second fluid path through which fluid flows from the bridge passage 60 to the second work passage 55. Assuming that the pressure of this fluid is greater than the pressure at the second workport 24, the pressure in the second work passage 55 forces that main poppet in the second pilot-operated check valve 72 away from its valve seat 86. That movement opens the path between then second work passage 55 and the second workport 24, thereby furnishing fluid from the supply conduit 18 to the hydraulic actuator 14. It should be understood that in this first operating mode, the pressure level in the second pilot pressure passage 92 in insufficient to cause pusher 88 of the second pilot-operated check valve 72 to exert enough force on the associated pilot poppet 78 to open pilot passage 80 and affect the aforementioned operation of that check valve. Therefore, the second pilot-operated check valve 72 is in a deactivated state in the first operating mode.

When it is desired to move the hydraulic actuator 14 in the opposite direction, the valve assembly 20 is placed into the second operating mode in which fluid from the supply conduit 18 is furnished to the first workport 22 and other fluid is drained from the second workport 24 into the tank conduit 26. In this case, the valve assembly 20 operates in a similar manner to the first operating mode, except that the motion of the spool 48 is reversed and the functions of the first and second pilot-operated check valves 71 and 72 are interchanged. This is accomplished by operating the first and second pilot valves 41 and 42 to create a third pressure level in the first pilot pressure passage 45 that is less than a fourth pressure level produced in the second pilot pressure passage 92. That pressure differential acting on the first and second surfaces 90 and 94 causes the spool 48 to move to the right in FIG. 2 and into a second position. In the second position, a third path through the spool conveys supply fluid from the bridge passage 60 to the first work passage 54 and a fourth path through the spool conveys fluid from the second work passage 55 into the second tank passage 53. The pressure of the supply fluid in the first work passage 54 forces the first pilot-operated check valve 71 open even though the pressure level in the first pilot pressure passage 45 keeps that check valve in a deactivated state. The pressure level in the second pilot pressure passage 92 pilot activates the second pilot-operated check valve 72 to open a path between the second work passage 55 and the second tank passage 53.

In the centered third position illustrated in FIG. 2, the spool 48 provides paths between the first and second work passages 54 and 55 and the tank passages 52 and 53, respectively. When the first and second pilot valves 41 and 42 are both de-energized, thereby connecting the first and second pilot pressure passages 45 and 92 to the tank passage 53, both the first and second pilot-operated check valves 71 and 72 are in the deactivated state. In the deactivated state, those check valves 71 and 72 block fluid from flowing from the respective workport 22 or 24 to the spool valve 40. As a result the hydraulic actuator 14 holds its existing position.

Now, assume that electric currents are applied to energize the first and second pilot valves 41 and 42 so as to produce approximately equal pressure levels in the first and second pilot pressure passages 45 and 92. Such equal pressure levels exert the about the same amount of force on the first and second actuator surfaces 90 and 94 at opposite ends of the spool 48, thus the spool remains at the centered, third position. Nevertheless, the elevated pressure levels in the first and second pilot pressure passages 45 and 92 are sufficiently large to cause the two pilot-operated check valves 71 and 72 to open. As a result, the first and second workports 22 and 24 are respectively connected to the first and second work passages 54 and 55. Because the centered position of the spool 48 provides paths from each of the first and second work passages 54 and 55 to the tank passages 52 and 53, the hydraulic actuator 14 is able to float. The term "float" means that the hydraulic actuator 14 is able to move freely in response to changes in the load force acting on the hydraulic actuator as there is negligible hydraulic resistance to that motion. The float function is disabled or enabled by de-energizing or appropriately energizing the first and second solenoid valves 41 and 42.

Providing a float function with previous spool valves required that the spool had a fourth position. Typically in the third position both work passages were closed and did not communicate with either the supply conduit or the tank conduit. Thus the hydraulic actuator did not float. In the fourth position of the spool, both work passages were connected to the tank conduit, enabling the hydraulic actuator to float. The fourth position increased the lengths of the spool and the valve body, which enlarged the size of the valve assembly resulting in a more costly valve. The present valve assembly 20 with the pilot-operated check valves 71 and 72 eliminates the need for that fourth position. In the open to tank center position of the spool valve 40, the two check valves 71 and 72 remain closed blocking fluid flow to and from the workports until the pilot valves 41 and 42 are energized to provide the float function. In addition, by proportionally controlling the pilot valve 41 and 42, the amount that each of the two check valves 71 and 72 opens is actively controlled, thereby providing a variable float function.

On machines in which a float function is not required, the present control technique can be used with a valve that has a closed centered third position. Also for certain machines, the present control technique can be applied to double acting spool valve with two workports, but which has only one pilot-operated check valve. The principles of the present control technique can be used with a single acting valve that has only one workport.

The foregoing description was primarily directed to one or more embodiments of the invention. Although some attention has been given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A valve assembly comprising:

a first workport for connecting a hydraulic actuator to the valve assembly;

a second workport for connecting the hydraulic actuator to the valve assembly;

a first pilot valve selectively varying a first pressure signal;

a second pilot valve selectively varying a second pressure signal;

a pilot-operated spool valve having a spool that moves into a plurality of positions in response to the first pressure signal and the second pressure signal applied to the spool, wherein the spool has a first position in which a first fluid path is formed between a first work passage and a tank conduit and in which a second fluid path is formed between a second work passage and a supply conduit, and has a second position in which a third fluid path is formed between the first work passage and the supply conduit and in which a fourth fluid path is formed between the second work passage and the tank conduit;

a first check valve operably connected to the first pressure signal and to respond to the first pressure signal by selecting either a first state or a second state, wherein in the first state the first check valve allows fluid to flow only in a direction from the first work passage to the first workport and in the second state the first check valve allows fluid to flow in either direction between the first work passage and the first workport, and in the second state the first check valve controls fluid flow there through in response to pressures acting thereon to maintain a first predefined pressure level in the first work passage; and a second check valve operably connected to the second pressure signal and to respond to the second pressure signal by selecting either a third state or a fourth state, wherein in the third state the second check valve allows fluid to flow only in a direction from the second work passage to the second workport, and in the fourth state the second check valve allows fluid to flow in either direction between the second work passage and the second workport, and in the fourth state the second check valve controls fluid flow there through in response to pressures acting thereon to maintain a second predefined pressure level in the second work passage.

2. The valve assembly as recited in claim 1 wherein:

the spool has a first surface to which the first pressure signal is applied and has a second surface to which the second pressure signal is applied;

the first check valve has a first control port for receiving the first pressure signal; and the second check valve has a second control port for receiving the second pressure signal.

3. The valve assembly as recited in claim 2 having a first operating mode wherein:

the first pilot valve applies the first pressure signal at a first pressure level to both the first surface and the first control port thereby placing the first check valve in the second state; and the second pilot valve applies the second pressure signal at a second pressure level to both the second surface and the second control port thereby placing the second check valve in the third state, wherein the first pressure level is greater than the second pressure level;

wherein the first and second pressures levels cause the spool to move into the first position.

4. The valve assembly as recited in claim 3 having a second operating mode wherein:

the first pilot valve is operated to apply the first pressure signal at a third pressure level to both the first surface and the first control port thereby placing the first check valve in the first state; and the second pilot valve is operated to apply the second pressure signal at a fourth pressure level to both the second surface and the second control port thereby placing the second check valve in the fourth state, wherein the fourth pressure level is greater than the third pressure level;

wherein the third and fourth pressure levels cause the spool to move into the second position.

5. The valve assembly as recited in claim 3 having another operating mode wherein:

the first pilot valve is operated to apply the first pressure signal at a fifth pressure level to both the first surface and the first control port; and the second pilot valve is operated to apply the first pressure signal at a sixth pressure level from the supply conduit to both the second surface and the second control port, wherein the fifth pressure level is substantially equal to the sixth pressure level.

6. The valve assembly as recited in claim 1 wherein the spool has a third position in which a fluid paths are formed between the tank conduit and both the first work passage and the second work passage.

7. The valve assembly as recited in claim 6 wherein while the spool is in the third position, the first check valve is in the second state and the second check valve is in the fourth state.

8. The valve assembly as recited in claim 1 wherein the first pilot valve produces the first pressure signal by connecting a first outlet selectively to the supply conduit and the tank conduit; and the second pilot valve produces the second pressure signal by connecting a second outlet selectively to the supply conduit and the tank conduit.

9. The valve assembly as recited in claim 1 wherein the first pilot valve and the second pilot valve are electrically operated.

10. The valve assembly as recited in claim 1 wherein the first pilot valve and the second pilot valve are spool valves.

11. The valve assembly as recited in claim 1 wherein:

the first check valve comprises a first main poppet that engages and disengages a first valve seat to control fluid flow between the first work passage and the first workport, wherein the first main poppet has a first pilot passage providing a fluid path between the first work passage and a first control chamber, the first check valve including a first pilot poppet biased to close the first pilot passage, and a first pilot pusher that responds to the first pressure signal by exerting force on the first pilot poppet thereby opening the first pilot passage; and the second check valve comprises a second main poppet that engages and disengages a second valve seat to control fluid flow between the second work passage and the second workport, wherein the second main poppet has a second pilot passage providing a fluid path between the second work passage and a second control chamber, the second check valve including a second pilot poppet biased to close the second pilot passage, and a second pilot pusher that responds to the second pressure signal by exerting force on the second pilot poppet thereby opening the second pilot passage.

12. A valve assembly comprising:

a pilot-operated spool valve having a spool with opposing first and second surfaces, wherein the spool moves into a plurality of positions in response to pressures applied to the first and second surfaces, wherein the spool has a first position in which a first fluid path is formed between a first work passage and a supply conduit, and has a second position in which a second fluid path is formed between the first work passage and a tank conduit;

a first pilot-operated check valve having a first control port, pressure at which selects a first deactivated state and a first activated state, wherein the first pilot-operated check valve in the first deactivated state allows fluid to flow only in a direction from the first work passage to a first workport and in the first activated state allows fluid to flow in either direction between the first work passage and the first workport, and further in the first activated state the first check valve controls fluid flow there through in response to pressures acting thereon to maintain a first predefined pressure level in the first work passage;

a first pilot valve selectively controlling application of pressure to both the first surface and the first control port; and a second pilot valve selectively controlling application of pressure to the second surface.

13. The valve assembly as recited in claim 12 having a first operating mode wherein:

the first pilot valve is operated to apply the first pressure signal at a first pressure level to both the first surface and the first control port thereby placing the first pilot-operated check valve in the first deactivated state; and the second pilot valve is operated to apply the second pressure signal at a second pressure level to the second surface, wherein the first pressure level is greater than the second pressure level;

wherein the first and second pressures levels cause the spool to move into the first position.

14. The valve assembly as recited in claim 13 having a second operating mode wherein:

the first pilot valve is operated to apply a third pressure to both the first surface and the first control port thereby placing the first pilot-operated check valve in the first activated state; and the second pilot valve is operated to apply a fourth pressure level to the second surface, wherein the fourth pressure is greater than the third pressure;

wherein the third and fourth pressures cause the spool to move into the second position.

15. The valve assembly as recited in claim 12 having an operating mode wherein:

the spool has a third position in which a fluid path is formed between the tank conduit and the first work passage;

the first pilot valve is operated to apply the first pressure signal at a first given pressure level to both the first surface and the first control port; and the second pilot valve is operated to apply the first pressure signal at a second given pressure level from the supply conduit to the second surface, wherein the first given pressure level is substantially equal to the second given pressure level.

16. The valve assembly as recited in claim 12 wherein the spool in the first position also forms a third fluid path between a second work passage and the tank conduit and in the second position also forms a fourth fluid path between the second work passage and the supply conduit; and further comprising a second pilot-operated check valve that has a second control port, pressure at which selects a second deactivated state in which the second check valve allows fluid to flow only in a direction from the second work passage to a second workport and a second activated state in which the second check valve allows fluid to flow in either direction between the second work passage and the second workport, and further in the second activated state the second check valve controls fluid flow there through in response to pressures acting thereon to maintain a second predefined pressure level in the second work passage.

17. The valve assembly as recited in claim 16 comprising:

a first operating mode wherein the first pilot valve is operated to apply the first pressure to both the first surface and the first control port thereby placing the first pilot-operated check valve in the deactivated state, and the second pilot valve is operated to apply the second pressure to both the second surface and the second control port thereby placing the second pilot-operated check valve in the activated state, wherein the first pressure is greater than the second pressure thereby causing the spool to move into the first position; and a second operating mode wherein the first pilot valve is operated to apply a third pressure to both the first surface and the first control port thereby placing the first pilot-operated check valve in the activated state, and the second pilot valve is operated to apply a fourth pressure level to both the second surface and the second control port thereby placing the second pilot-operated check valve in the deactivated state, wherein the fourth pressure is greater than the third pressure thereby causing the spool to move into the second position.

18. A method for operating a valve assembly, wherein the valve assembly comprises a pilot-operated spool valve having a spool that is moveable into a plurality of positions in response to pressures applied to first and second surfaces of the spool, wherein in those positions the spool selectively controls fluid flow to and from a first work passage and a second work passage, a first pilot-operated check valve that responds to pressure applied to a first control port by controlling directions in which fluid is able to flow between the first work passage and a first workport, a second pilot-operated check valve that responds to pressure applied to a second control port by controlling directions in which fluid is able to flow between the second work passage and a second workport, a first pilot valve for applying different pressures to the first control port, and a second pilot valve for applying various pressures to the second control port; said method comprising:

operating a valve assembly in a first operating mode wherein:

(a) the first pilot valve is operated to apply a first pressure level to both the first surface and the first control port thereby opening the first pilot-operated check valve, (b) the second pilot valve is operated to apply a second pressure level to both the second surface and the second control port thereby placing the second pilot-operated check valve in a state in which fluid is allowed to flow only in a direction from the second work passage to the second workport, and (c) the first pilot-operated check valve responds to pressures acting thereon by controlling fluid flow between the first work passage and the first workport to maintain a first predefined pressure level in the first work passage, wherein the first pressure level is greater than the second pressure level, and the first and second pressure levels cause the spool to move into the first position; and operating a valve assembly in a second operating mode wherein:

(d) the first pilot valve is operated to apply a third pressure level to both the first surface and the first control port thereby placing the first pilot-operated check valve in which fluid is allowed to flow only in a direction from the first work passage to the first workport, (e) the second pilot valve is operated to apply a fourth pressure level to both the second surface and the second control port thereby opening the second pilot-operated check valve, and (f) the second pilot-operated check valve responds to pressures acting thereon by controlling fluid flow between the second work passage and the second workport to maintain a second predefined pressure level in the second work passage, wherein the fourth pressure is greater than the third pressure, and the third and fourth pressure levels cause the spool to move into the second position.

19. The method as recited in claim 18 having a third operating mode wherein:

(g) the first pilot valve is operated to apply a fifth pressure level to both the first surface and the first control port thereby opening the first pilot-operated check valve; and (h) the second pilot valve is operated to apply a sixth pressure level to both the second surface and the second control port thereby opening the second pilot-operated check valve;

wherein the fifth pressure level is substantially equal to the sixth pressure level.

20. The method as recited in claim 19 wherein when operating the valve assembly in the third operating mode, the spool is in a position in which a first fluid path is formed between a tank and the first work passage and a second fluid path is formed between the tank and the second work passage.

* * * * *